US005979083A

United States Patent [19]

Robinson et al.

[11] Patent Number: 5,979,083

[45] **Date of Patent: *Nov. 9, 1999**

[54] MULTI-LAYER OUTSOLE

[75] Inventors: Douglas K. Robinson, Mansfield, Mass.; John F. Lane, III, Stratham, N.H.; John J. Erickson, Brockton, Mass.

[73] Assignee: Acushnet Company, Fairhaven, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 09/012,430

[22] Filed: Jan. 23, 1998

[51] Int. Cl.[6] ..... A43B 5/00; A43C 15/02

[52] U.S. Cl. ..... 36/127; 36/59 R; 36/59 C; 36/134; 36/67 A; 36/102

[58] Field of Search ..... 36/59 R, 59 C, 36/134, 67 R, 67 A, 67 B, 67 C, 67 D, 127

[56] References Cited

U.S. PATENT DOCUMENTS

| | | |
|---|---|---|
| Re. 21,173 | 8/1939 | Fuller . |
| D. 266,371 | 10/1982 | Stubblefield . |
| D. 288,262 | 2/1987 | Yokoishi . |
| D. 290,781 | 7/1987 | Grubel . |
| D. 303,871 | 10/1989 | Driscoll . |
| D. 351,495 | 10/1994 | Nagai et al. . |
| 1,749,351 | 3/1930 | McQueen . |
| 4,677,765 | 7/1987 | Lubet et al. . |
| 4,747,220 | 5/1988 | Autry et al. . |
| 5,077,916 | 1/1992 | Beneteau . |
| 5,367,791 | 11/1994 | Gross et al. . |
| 5,533,282 | 7/1996 | Kataoka et al. . |

OTHER PUBLICATIONS

Titleist and Foot–Joy Worldwide Catalog, 1997, U.S.A., Cover page and pp. 25, 27, 32, 33, 38.

Robinson et al., U.S. Design Patent Application entitled "Golf Shoe Sole," filed Jan. 23, 1998, Serial No. (Unassigned).

*Primary Examiner*—Ted Kavanaugh

*Attorney, Agent, or Firm*—Pennie & Edmonds LLP

[57] ABSTRACT

The present invention is directed towards a two-layer outsole for use with a shoe. The outsole includes an outer layer, an inner layer, and a longitudinally extending axis. The outer layer forms the bottom of the outsole and has a plurality of first holes at spaced locations therethrough. The inner layer includes a base adjacent one side of the outer layer and a plurality of projections that extend from the base through the first holes in the outer layer, and terminate in a pointed free end. The projections protrude from the bottom of the outsole, and provide traction when the outsole interacts with the ground. The free end also forms a ridge. The ridge of each projection is substantially parallel to the longitudinal axis. In one embodiment, each projection has an outline with a tear-drop shape. It has been found that when projections with this configuration are used with non-metal cleats, excellent traction is obtained.

34 Claims, 6 Drawing Sheets

MULTI-LAYER OUTSOLE

TECHNICAL FIELD

The present invention relates generally to shoes, and more particularly to multi-layer outsoles for use on golf shoes.

BACKGROUND OF THE INVENTION

A golfer's performance depends substantially on the ability of the golfer's shoes to provide a solid base of support. To that end, golf shoes generally include a shoe upper joined to an outsole, where the bottom surface of the outsole includes numerous metal spikes for providing traction. These spikes are characterized as cone-shaped protrusions.

The traction provided by the metal spikes upon interaction between the outsole and the ground enables the golfer to perform the body movements necessary to culminate in an ideal contact between the club head and the ball (i. e., a golf swing). Golf shoes should also flex during walking to provide comfort and relief from strain to the golfer's feet.

Although metal spikes provide the necessary traction, one significant problem with them is their propensity to damage the turf of golf courses. This damage can be in the form of, for example large indentations, dislodged turf, or compacted turf. This damage can increase the frequency of golf course maintenance, and consequently increase the operating costs of golf courses, which is undesirable. Also golf balls that contact the damaged turf can travel erratically, which is undesirable. As a result, there is a trend today towards banning metal spikes.

In an effort to provide traction, while minimizing turf damage, non-metal spikes have been devised. U.S. Pat. No. 5,077,916 issued to Beneteau discloses an outsole without metal spikes, that has protrusions with blunt free ends. One problem with the solution taught in the Beneteau patent is that turf compaction is still likely due to the blunt free ends of the projections.

U.S. Pat. No. 4,747,220 issued to Autry et al. discloses running shoes that include an outsole glued to a cleat layer. The cleat layer includes a plurality of flat topped non-metal cleats. One problem with this solution is the outsole and cleat layer could separate due to failure of the glue. Furthermore, the flat tops of the cleats may not afford the traction necessary for optimal performance during the golf swing, and may compact the turf.

U.S. Pat. No. 5,367,791 issued to Gross et al. discloses an athletic shoe for activities such as walking and playing tennis. This shoe includes a separate outsole, midsole, and insert, which are cemented together. The insert includes tips that terminate at a substantially horizontal lower face. The tips may not provide adequate traction during a golf swing, and they may compact the turf due to their flat lower face. Another problem with this solution is the possibility of the layers separating due to failure of the cement.

Thus, there remains a need for an improved outsole that provides adequate traction during a golf swing, and minimizes damage to the turf of golf courses. It is desired that the improved outsole include non-metal spikes; however, it is also desired that the outsole is adaptable so that metal spikes are usable if desired.

SUMMARY OF THE INVENTION

The present invention is directed towards an outsole without metal spikes, which provides good comfort similar to a conventional outsole, while also providing better traction than that of a conventional substantially smooth bottomed outsole with metal spike.

The present invention is further directed towards a two-layer outsole. The outsole includes an outer layer, an inner layer, and a longitudinally extending axis. The outer layer forms the bottom of the outsole and has a plurality of first holes at spaced locations therethrough. The inner layer includes a base adjacent one side of the outer layer and a plurality of projections that extend from the base through the first holes in the outer layer, and terminate in a pointed free end. The free end also forms a ridge. The ridge of each projection is substantially parallel to the longitudinal axis. In one embodiment, each projection has a conical portion, which includes the pointed free end. It has been found that when projections with this configuration are used with non-metal cleats, excellent traction is obtained. In another embodiment, each projection has an outline with a tear-drop shape. In yet another embodiment, each projection outline has a width that is greater than a diameter of the first holes, and engaged with the outer layer so that the layers are interlocked.

The present invention is still further directed to an outsole where the outer layer is formed of a plurality of longitudinally spaced pieces, and the base extends between the pieces to form hinges. It is preferred that the outer layer is formed of three such longitudinally spaced pieces, and the base forms two hinges that underlie the metatarsal area of a wearer's foot. In this way, the outsole has good flexibility for comfort.

In one embodiment, the outer layer and the inner layer are formed from thermoplastic polyurethanes. In another embodiment, the outer layer material is harder than the inner layer material, which is flexible. This allows the inner layer to act as the hinge between the outer layer pieces.

The invention thus provides a novel outsole that offers the benefit of minimizing damage to the turf of a golf course while providing traction and comfort.

DETAILED DESCRIPTION OF THE PREFERRED EMBODIMENT OF THE INVENTION

Figure 1:
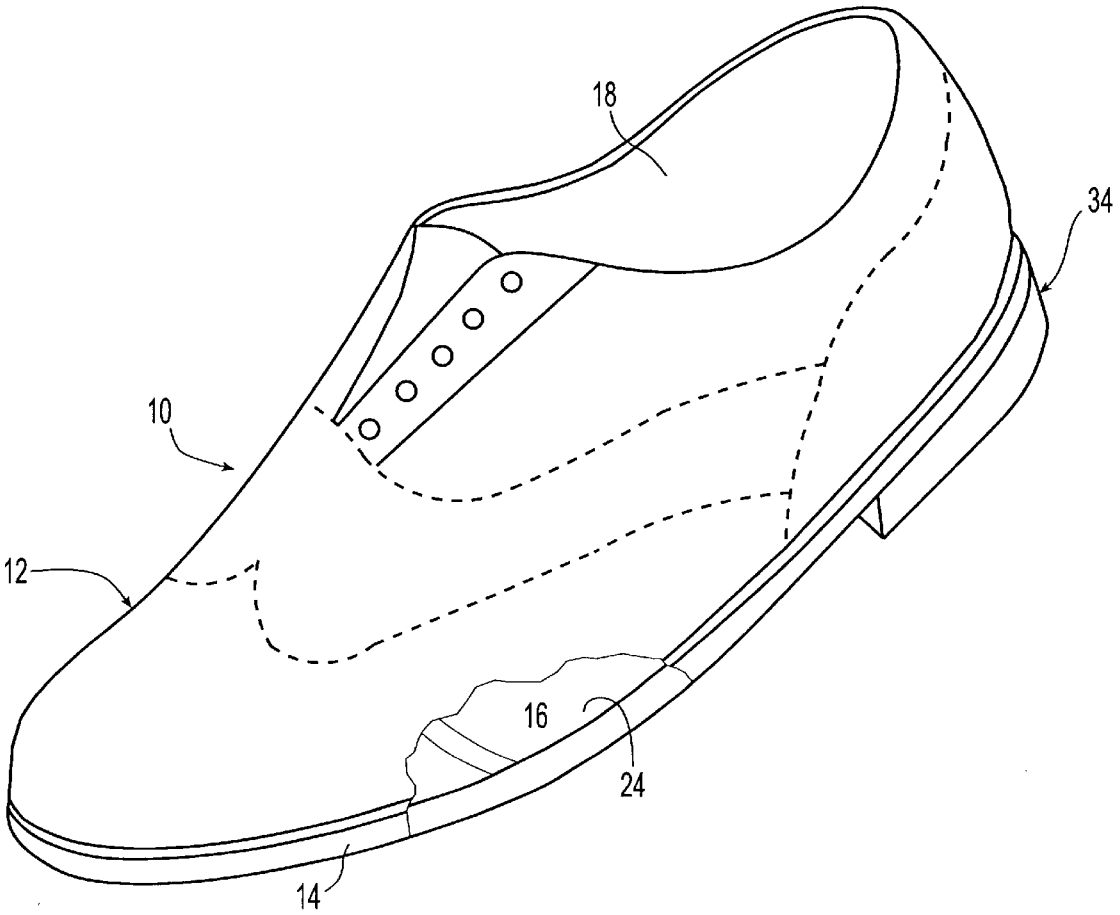
FIG. 1 is a top, perspective view of a golf shoe with a portion broken away to expose an outsole of the present invention.

Referring to FIG. 1, there is illustrated an embodiment of a golf shoe 10 according to the present invention, which includes an upper 12, a midsole 14, and an outsole 16. The upper 12 is conventional and formed from a suitable material, such as leather or the like. The upper 12 is joined to the midsole 14 using cement or the like and conventional techniques. Once joined thereto the upper 12 defines an opening 18 for receiving a wearer's foot (not shown).

The midsole 14 provides cushioning to the wearer, and is formed of a material such as ethylene vinyl acetate copolymer (EVA). The midsole 14 is formed around the outsole 16 so that the midsole 14 encases the edges of the outsole 16 except for the heel section 34. Once the midsole and outsole are joined, the outsole forms the bottom of the shoe 10.

Figures 2, 4:
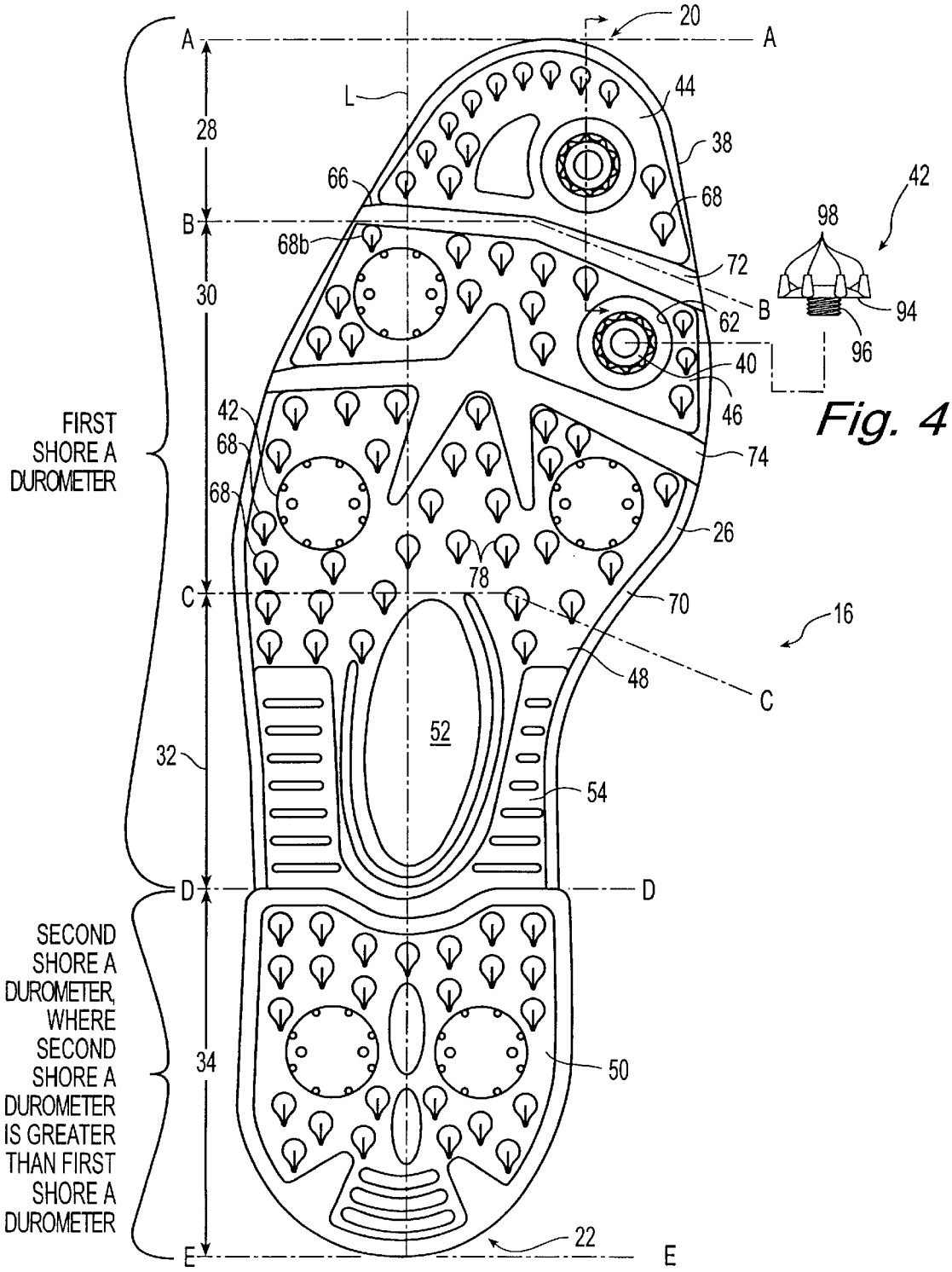
FIG. 2 is a bottom view of the outsole of the present invention.
FIG. 4 is a side view of a cleat for use with the outsole of the present invention.
Figure 3:
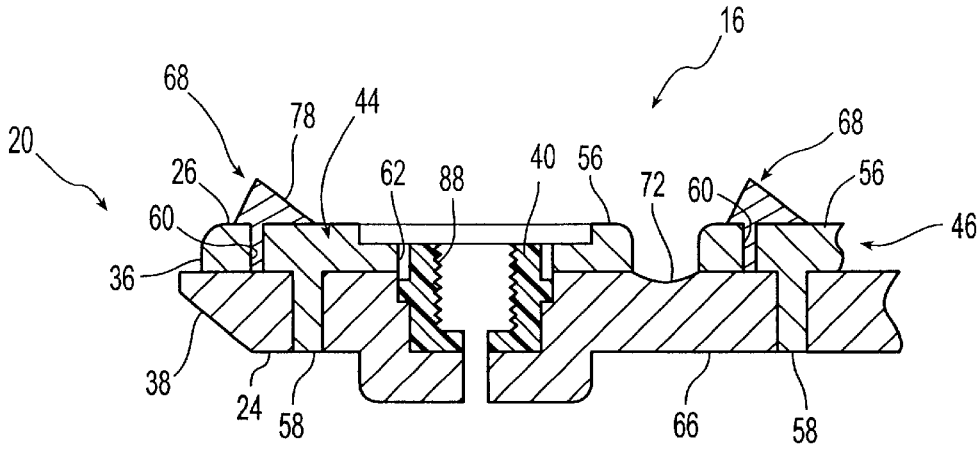
FIG. 3 is a partial, cross-sectional view of the outsole of the present invention along line 3—3 of FIG. 2.

Referring to FIGS. 1–3, the outsole 16 includes a first or forward end 20, a spaced second or rear end 22, a first surface 24, and an opposed second surface 26. The first surface 24 forms the upper surface of the outsole, to which the midsole 14 is joined. The second surface 26 is the bottom surface to the shoe that contacts the turf. The outsole 16 further includes a longitudinal axis L, which extends between the forward end 20 and the rear end 22.

Referring to FIG. 2, the bottom surface 26 of the outsole 16 is defined by a plurality of sections: the toe section 28, the forefoot section 30, the shank section 32, and the heel section 34. The toe section 28 is defined as the section of the outsole 16 that underlies the toes of the wearer's foot, and is depicted as the section between lines AA and BB. The forefoot section 30 is defined as the section of the outsole 16 that underlies the metatarsal pad of the wearer's foot, and is depicted as the section between lines BB and CC. The shank section 32 is defined as the section of the outsole 16 that underlies the arch of the wearer's foot, and is depicted as the section between lines CC and DD. The heel section 34 is definedvs the section of the outsole 16 that underlies the heel of the wearer's foot and is depicted as the section between lines DD and EE.

Referring to FIG. 3, the outsole 16 is formed of a first or outer layer 36, a second or inner layer 38, and includes receptacles, represented by the receptacle 40.

Referring to FIGS. 2 and 3, the outer layer 36 is formed of discrete pieces including a toe piece 44, a forefoot piece 46, a shank piece 48, and a heel piece 50. The shank piece 48 further includes a logo assembly 52, and an arch insert 54. Each piece 44, 46, 48, and 50 extends across the width of the inner layer 38, and longitudinally along the corresponding outsole section 28, 30, 32, and 34.

Referring to FIGS. 3 and 4, each discrete piece, two of which are shown 44 and 46, includes a base 56 and at least one integrally formed cylindrical post 58 extending outwardly from the base 56. The base 56 forms the bottom surface 26 of the shoe 10. It is preferred that the posts 58 are located about the periphery of each discrete piece and at spaced locations across and along the pieces, particularly around any cutouts and holes in the pieces. The posts 58 provide addition surface area for bonding of the two layers 36 and 38.

Figure 5:
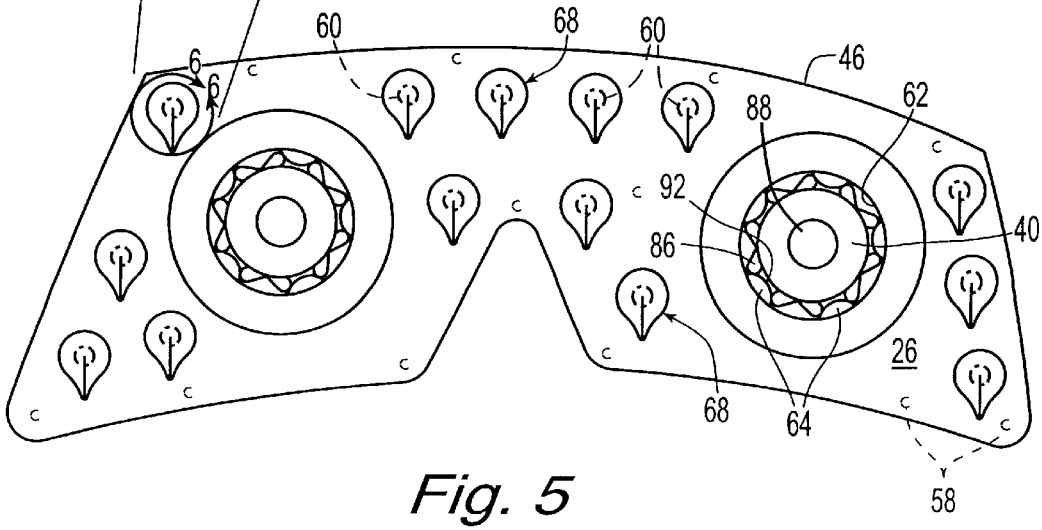
FIG. 5 is an enlarged, bottom view of a portion of the outsole of the present invention.

Referring to FIGS. 3 and 5, each base 56 defines a plurality of first holes 60 and a plurality of second holes 62. The holes 60 and 62 extend between the surfaces of the outer layer 36. The first holes 60 are distributed about each discrete piece so that a predetermined layout of projections 68 (as shown in FIG. 2) is achieved on the outsole 16. The projections 68 are disbursed so that they are located across each piece from side-to-side and along each piece from front to back.

Referring to FIGS. 4 and 5, the second holes 62 are disposed in spaced locations on each discrete piece near the periphery of the outsole to be discussed in detail below with respect to the cleats 42. The wall of each second hole 62 further includes inwardly extending tabs 64 at spaced circumferential locations.

Referring to FIGS. 2 and 3, the inner layer 38 of the outsole 16 includes a base 66 and the plurality of projections 68. The base 66 is adjacent one surface of the outer layer 36. Thus, the inner layer 38 interconnects the discrete pieces 44, 46, 48, and 50 of the outer layer 36.

As shown in FIG. 2, the base 66 forms an edge 70 around the periphery of each discrete piece 44, 46, 48, and 50. The discrete pieces are spaced apart and interconnected by the base 66 to form hinges between the discrete pieces in the form of two longitudinally spaced grooves 72 and 74. The first groove 72 is located between the toe piece 44 and the forefoot piece 46. The second groove 74 is located between the forefoot piece 46 and the shank piece 48. The outsole 16 has a length from the forward end 20 to the rear end 22, and the hinges are located within between about 30% to about 35% of the outsole length measured from the forward end 20, so that the hinges underlie a wearer's forefoot, where bending of the outsole is necessary to complement a wearer's foot action when walking.

Referring to FIG. 3, the base 66 is formed so that the thickness of the base 66 along each of the grooves 72 and 74 is thin enough for the grooves to serve as hinges about which the discrete pieces flex as a wearer walks. The grooves, as represented by the groove 72, have a circular cross-section, which decreases the thickness of the base 66 at the groove.

Referring to FIG. 3, the projections 68 extend from the base 66 through the associated first hole 60 and extend outwardly from the bottom surface 26 of the outer layer 36.

Figure 7:
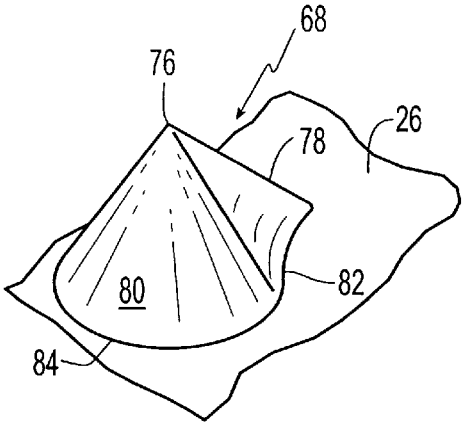
FIG. 7 is an enlarged, perspective view of the first embodiment of the projection.
Figure 8:
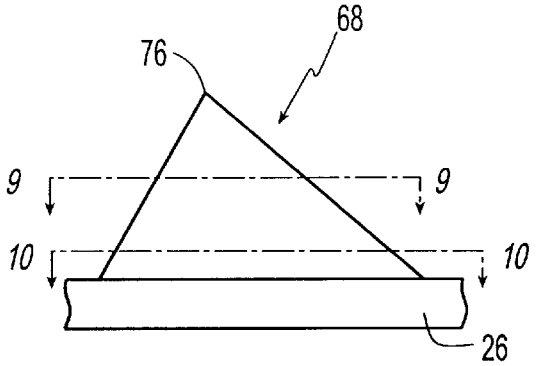
FIG. 8 is an enlarged, side view of the first embodiment of the projection of FIG. 7.
Figure 9:
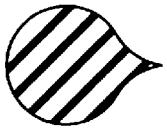
FIG. 9 is a cross-sectional view of the first embodiment of the projection along line 9—9 of FIG. 8.
Figure 10:
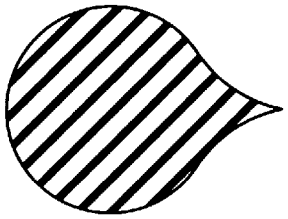
FIG. 10 is a cross-sectional view of the first embodiment of the projection along line 10—10 of FIG. 8.

Referring to FIG. 7, each projection 68 includes a pointed free end 76 and a ridge 78. The shape of each projection is formed by a front conical portion 80 and a rear sloped portion 82 integral therewith. The outline 84 of the projection 68 is engaged with the bottom surface 26 (as shown in FIG. 2), and has a tear-drop shape similar to that shown in FIG. 10. The tear-drop shape includes a rounded end and an opposed tapered end. The rounded ends of each projection 68 are closer to the forward end of the outsole, and the tapered ends of each projection are closer to the rear end of the outsole.

Referring to FIGS. 7–10, the conical front portion 80 extends outwardly from the bottom surface 26 to terminate in the pointed free end 76. The free end 76 has a surface area (as shown in FIG. 7) that is small enough when exposed to the force of the wearer, so that when the tip 76 contacts the turf, it will have sufficient pressure to penetrate the turf cleanly. Thus, the tip 76 of each projection 68 allows better penetration into the turf with small indentations, when the user walks, which will reduce the noticeable damage that is done to the turf.

Figure 6:
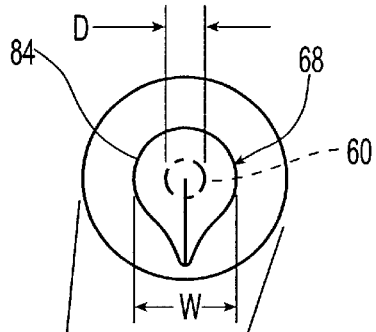
FIG. 6 is an enlarged, plan view of a first embodiment of a projection shown in the circle 6—6 of FIG. 5 for use with the outsole of the present invention.

Referring to FIGS. 5 and 6, an outline width of the projection 68 is indicated by the arrow W. The associated first hole 60 has a diameter indicated by the arrow D. In order for the inner layer 38 to be sufficiently interlocked with the outer layer 36, the outline width of the projections W is greater than the diameter of the first hole D. Preferably, the outline width of the projection W is twice the diameter of the first hole D. With the dimensions as stated above and the outline width occurring at the engagement of the projection 68 and the outer layer 36. The outer layer 36 to the inner layer 38 are mechanically interlocked.

Referring to FIG. 7, the rear portion 82 of each projection 68 extends outwardly from the bottom surface 26. The rear portion 82 is adjacent to the conical front portion 80. The rear portion 82 forms the angled ridge 78 at the intersection of its sloped sides. The angled ridge 78 extends between the tip 76 and the bottom surface 26. Referring to FIG. 3, the angled ridge 78 angles downwardly away from the first end 20 of the shoe.

Referring to FIG. 2, the projections 68 are arranged on the second surface 26 of the outsole 16 so that the ridges 78 of each projection are substantially parallel to the longitudinal axis L of the outsole 16. As a result of this orientation of the projections 68, the sides of the rear portion that form the ridge 78 bear against the ground and the necessary traction is achieved to resist the twisting and other forces generated during a golf swing.

Referring to FIG. 2, the number, spacing, and arrangement of projections 68 allows sufficient space between projections 68, so that the projections 68 have the necessary turf interaction. In this embodiment, the projections 68 cover less than 50% of the surface area of the outsole 16. More particularly, the projections 68 cover between about 20% to about 30% of the surface area of the outsole 16. In this embodiment, there are two sizes of projections, represented by the smaller projections 68*a* and the larger projections 68*b*. The projections 68*a* are shorter in length and height than the projections 68*b*. The smaller projections 68*a* are located primarily along the edge of the toe piece 44 closest to the forward end 20. This reduces the likelihood that the wearer of the shoe with the outsole 16 will trip when walking.

Referring to FIG. 3, in this embodiment, the outer layer 36 of the outsole 16 is formed from a first material, which is firm for lateral stability and durability. A recommended first material has a Shore A durometer from about 80 points to about 110 points, and more preferably has a Shore A durometer of between about 85 points to about 100 points. Furthermore, the specific gravity of the first material for the outer layer 36 ranges from between about 1.20 to about 1.30, and more preferably between about 1.22 and about 1.25.

The inner layer 38 of the outsole 16 is formed from a second material, which is soft for flexibility in the longitudinal direction. A recommended second material for the inner layer 38 for the outsole toe section to shank section has a Shore A durometer of between about 70 points to about 80 points, and more preferably having a Shore A durometer of about 75 points. The specific gravity of the second material from the toe section to the shank section for the layer 38 ranges from between about 1.19 to about 1.20. The second material for the heel section may have a Shore A and specific gravity greater than the first material due to the requirements in the heel section.

Referring to FIG. 2, the preferred first material for the toe piece 44, forefoot piece 46, shank piece 48, heel piece 50, and arch insert 54 is an ester thermoplastic urethane manufactured by Bayer under the name Desmopan® KU2-8785A; however, other thermoplastic polyurethanes can be used including PEBAX® manufactured by Elf Atochem S.A. PEBAX® is less preferred because it is expensive to purchase and mold. The preferred first material for a portion of the logo assembly 52 that contacts the ground is an ester-based thermoplastic polyurethane manufactured by URE-TECH CO., Ltd. located in Taiwan under the name Utechllan UTY-85A. This material is desirable because it is available as a transparent material so that a logo position therebeneath is visible. The preferred second material for the toe section through the shank is a polyester-type thermoplastic polyurethane manufactured by URE-TECH CO., Ltd. located in Taiwan under the name Utechllan U-75AP.

Referring to FIGS. 3–5, each receptacle 40 for the cleats 42 is located within the associated second hole 62. Each receptacle 40 includes pairs of tabs 86 circumferentially spaced about the receptacle outer surface, and an internally threaded bore 88 for receiving the cleats 42. Each pair of receptacle tabs 86 are spaced apart to form a gap 92 therebetween. The receptacles 40 are commercially available from the manufacturer TriSport Limited located in the United Kingdom under the name DELRIN® Receptacle. DELRIN® is a trademark of E.I. Du Pont De Nemours and Company.

Referring to FIG. 2, in the preferred embodiment, there are at least seven (7) cleats 42. There is one cleat (not shown) in the toe section 28, two cleats (one removed for clarity) in the forefoot section 30, two cleats in the shank section 32, and two cleats in the heel section 34.

Referring to FIG. 4, each cleat 42 includes a head 94 and an integral threaded shank 96 that extends from one side of the head 94. A plurality of projections 98 extend outwardly from the opposite side of the head 94 about its periphery. Referring to FIGS. 3 and 4, each cleat 42 is attached to the outsole 16 by screwing the shank 96 into threaded engagement with the receptacle internal threaded bore 88. Both the cleats 42 and the receptacles 40 can be modified so that other engagement means aside from threads are provided. The recommended cleats 42 are commercially available from the manufacturer SOFTSPIKES® under the name SOFTSPIKES® XP™. These cleats 42 are formed of a polyurethane that is softer than the material from which the inner layer is formed. The cleats 42 provide additional traction to the outsole 16 in addition to the projections 68. One advantage of the cleats 42 is that they can be replaced after excessive wear. In another embodiment, metal spikes can be used with the receptacles of the present invention. This increases the versatility of the outsole, by allowing the use of non-metal cleats or metal spikes.

Referring to FIGS. 2 and 4, the height of both the projections 68 and the cleat projections 98 is determined so that the proper amount of traction is provided. However, the height may vary based on the requirements of the shoe sole. In this embodiment, initially the height of the cleat projections 98 is greater than the height of the projections 68. After use of the shoe, the cleat projections 98 wear down and their height equals the height of the projections 68. Since the cleat 42 material is softer than the material of the projections 68, the projections 68 help slow down the wear of the cleat projections 98.

Figure 11:
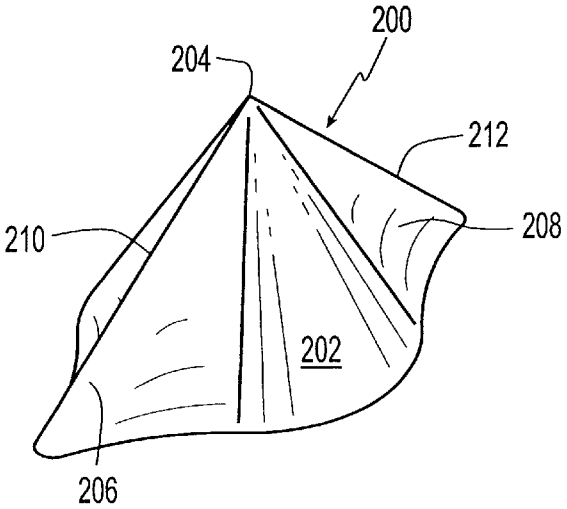
FIG. 11 is an enlarged, perspective view of an alternate embodiment of a projection for use with the outsole of the present invention.

Referring to FIG. 11, an alternative embodiment of a projection 200 for use with the outsole of the present invention is shown. This projection includes a conical central portion 202 with a pointed tip 204, a front portion 206 extending from one side of the central portion 202, and a rear portion 208 extending from the opposite side of the central portion 90. The front and rear portions 206, 208 each include angled ridges 210, 212, respectively, that terminate at the tip 204. Referring to FIGS. 2 and 11, the projections 200 are arranged on the outsole 16 so that the ridges 210 and 212 of each projection are substantially parallel to the longitudinal axis L of the outsole 16. In this way, these alternative projections 200 will also provide traction similarly to the first embodiment of the projections.

The method of forming the outsole of the present invention will now be discussed. Referring to FIGS. 2 and 3, the discrete toe piece 44, forefoot 46, and heel piece are formed from the first material by injection molding them in individual machines. The discrete pieces 44, 46, and 50 are molded with the first and second holes 60 and 62 therethrough, and the posts 58 formed thereon. In an alternate embodiment, the first and second holes 60 and 62 can be formed subsequent to molding by processes such as die cutting, punching, and the like. Then, the pieces 44, 46, and 50 are cured.

Referring to FIG. 2, in order to form the shank piece 48, the arch insert 54 is placed in a mold, and the first material is flowed thereon and bonds with the arch insert to form the shank piece 48. This assembly is cured. The logo and backer insert are position in a separate mold and the transparent material is injection molded therein. The transparent material encases the logo and backer insert forming a logo assembly 52 that is cured.

Referring to FIG. 2, the heel section 34 of the outsole 16 is formed as an assembly by placing the heel piece 50 into another molding machine, and injection molding of the inner layer second material onto the heel piece 50. In the preferred embodiment, the inner layer second material used in the heel area is harder than that for the remainder of the inner layer, because the heel area is subject to higher loads than the rest of the outsole, and is not required to flex. The base and projections of the inner layer are formed in the heel area during molding of the heel assembly.

Referring to FIGS. 2 and 3, the toe piece 44, the forefoot piece 46, the shank piece 48 with the insert 54, and the heel assembly are positioned in a final mold to form the outer layer 36. The pieces are spaced apart so that the general outline of the outsole 16 is formed. The internally threaded receptacles 40 are placed in the final mold through the second holes 62 in the discrete pieces of the outer layer so that the bore 88 is accessible from the bottom of the shoe. The logo assembly 52 is placed on top of the shank piece 48 so that the logo is visible.

Referring to FIG. 3, the inner layer 38 is formed by injection molding. During injection molding, the second material flows over the discrete pieces 44, 46, and 48 of the outer layer 36 to form the base 66 adjacent one surface of the discrete pieces. The base 66 surrounds the logo assembly 52 and posts 58, so that they are embedded therein. The heights of the inner layer 38 and posts 58 are such that the free end of each post is flush with the first surface 26 of the outsole 16. This inner layer material also bonds to the heel assembly to the remainder of the outsole.

Referring to FIGS. 3 and 5, the second material also flows over and encases the receptacles 40 and flows between the gaps 92 of each pair receptacle tabs 86. Upon curing the second material forms the tabs 64 between the receptacle tabs 86. The encasement of the receptacles 40 and the interconnection between the tabs 64 and 86 help the receptacles 40 remain fixed within the outsole.

Referring to FIG. 3, the second material also flows through the first holes 60 to form the projections 68 connected to the base 66. This connects the discrete pieces 44, 46, 48, and the heel assembly with the piece 50 with one another, but also mechanically interlocks the inner layer 38 with the outer layer 36 by virtue of the dimensions of the projections 68 and the first holes 66, as discussed above. Lastly, the entire outsole assembly is cured. The outer and inner layers also mechanically bond during manufacture along their joining surfaces including about the posts 58. The posts 58 provide additional boding surface area, to assure that particularly the edges of the outer layer discrete pieces are bonded to the inner layer.

Since the outer and inner layer materials have increased tensile strength and allow good interlocking, individual receptacles are used to secure the removable cleats, thus no cleat retaining plate is necessary. This allows the outsole of the present invention to have increased flexibility at the grooves 72, 74. Ethyl vinyl acetate outsoles are too soft and require the cleat retaining plate for securing the removable cleats, thus these types of outsoles are less flexible.

EXAMPLE

These and other aspects of the present invention may be more fully understood with reference to the following non-limiting example, which is merely illustrative of the preferred embodiment of the present invention outsole, and is not to be construed as limiting the invention, the scope of which is defined by the appended claims. The results obtained with outsoles prepared according to the example are representative of the improved performance characteristics of outsoles made from the compositions and in the configuration of this invention.

Table I sets forth the contents of the outsoles that were made to illustrate the effect of using outer layer material, which is harder than the inner layer material from the toe to the shank sections. The outer layer material; however varies in hardness between discrete pieces of the outer layer.

TABLE I

| Outsole Component | Shore A Durometer (Points) | Specific Gravity |
|---|---|---|
| Outer Layer Toe, Forefoot, and Heel Pieces | 85 | 1.23 |
| Outer Layer Shank Piece | 85 | 1.23 |
| Outer Layer Logo Assembly (transparent material) | 85 | 1.23 |
| Outer Layer Logo Assembly (backer insert) | 85 | 1.22 |
| Second Layer for Heel Section | 98 | 1.25 |
| Second Layer for Toe, Forefoot, and Shank Sections | 75 | 1.19–1.20 |

Figure 12:
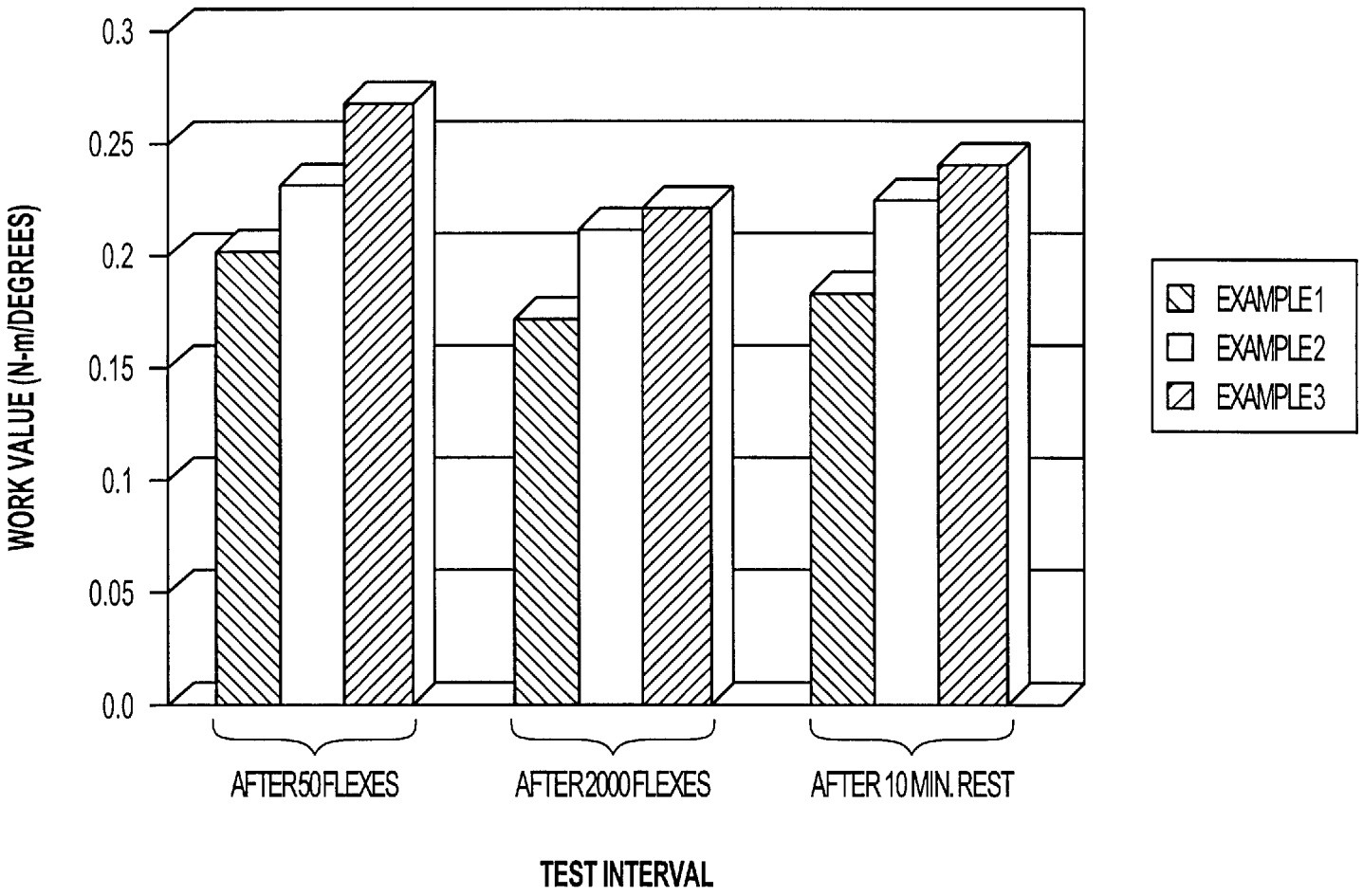
FIG. 12 is a graph comparing the flexibility of various conventional outsoles with the outsole of the present invention.

Referring to Table II and FIG. 12, test data obtained from shoes that have various outsole configurations is provided. In particular, the forefoot flexibility was measured for shoes including those according to the present invention. Example 1 has the outsole formed according to the present invention. Examples 2 and 3 have conventional outsoles (DryJoys® and DryJoys® GX, respectively) for comparison.

Each outsole was tested on a testing device which included two platforms connected by a hinge. One platform is fixed and the other is movable. The shoe is secured to the platform so that the outsole is in contact with the top of the platform and 40% of the shoe length measured back from the toe is aligned with the hinge. During testing the one platform moves, which flexes the shoe,and a load cell measures a force the shoe offers to resist this movement. The load cell force is converted to a work value required to produce the change in flex with units of N-m/degrees.

After flexing the shoes 50 times, a measurement is taken. After flexing the shoes 2000 times, which represents approximately the amount of flexes that occur during a 5 mile walk, another measurement is taken. After a 10 minute rest, which allows the shoes to cool, yet another measurement is taken. At each test interval, a number of trials are performed and an average of the values obtained appears in Table II.

Referring to FIG. 12, the lower the work value the easier it is to flex the shoe, and the more comfortable it will be to the wearer. Work values between 0.20 N-m/degrees to 0.40 N-m/degrees are acceptable. However, the lower the work value the better the shoe's flexibility performance.

TABLE II

Forefoot Flexibility Test Results

| Sample | Work Value After 50 Flexes (N-m/°) | Work Value After 2000 Flexes (N-m/°) | Work Value After 10 Min. Rest (N-m/°) |
|---|---|---|---|
| Example 1 | 0.2013 | 0.1723 | 0.1834 |
| Example 2 | 0.231 | 0.2112 | 0.2255 |
| Example 3 | 0.2678 | 0.2213 | 0.2417 |

Referring to FIG. 12 and Table II, outsoles according to the present invention (Example 1) have the lowest work value of all the samples at every test interval, and these work values are either within or below the acceptable range. Thus, the inventive outsole has superior flexibility performance over outsoles according to Examples 2 and 3. This performance is attributable to the presence of the flex grooves and the inner layer being formed of a material, which allows the discrete pieces adjacent the flex grooves to move.

Figure 13:
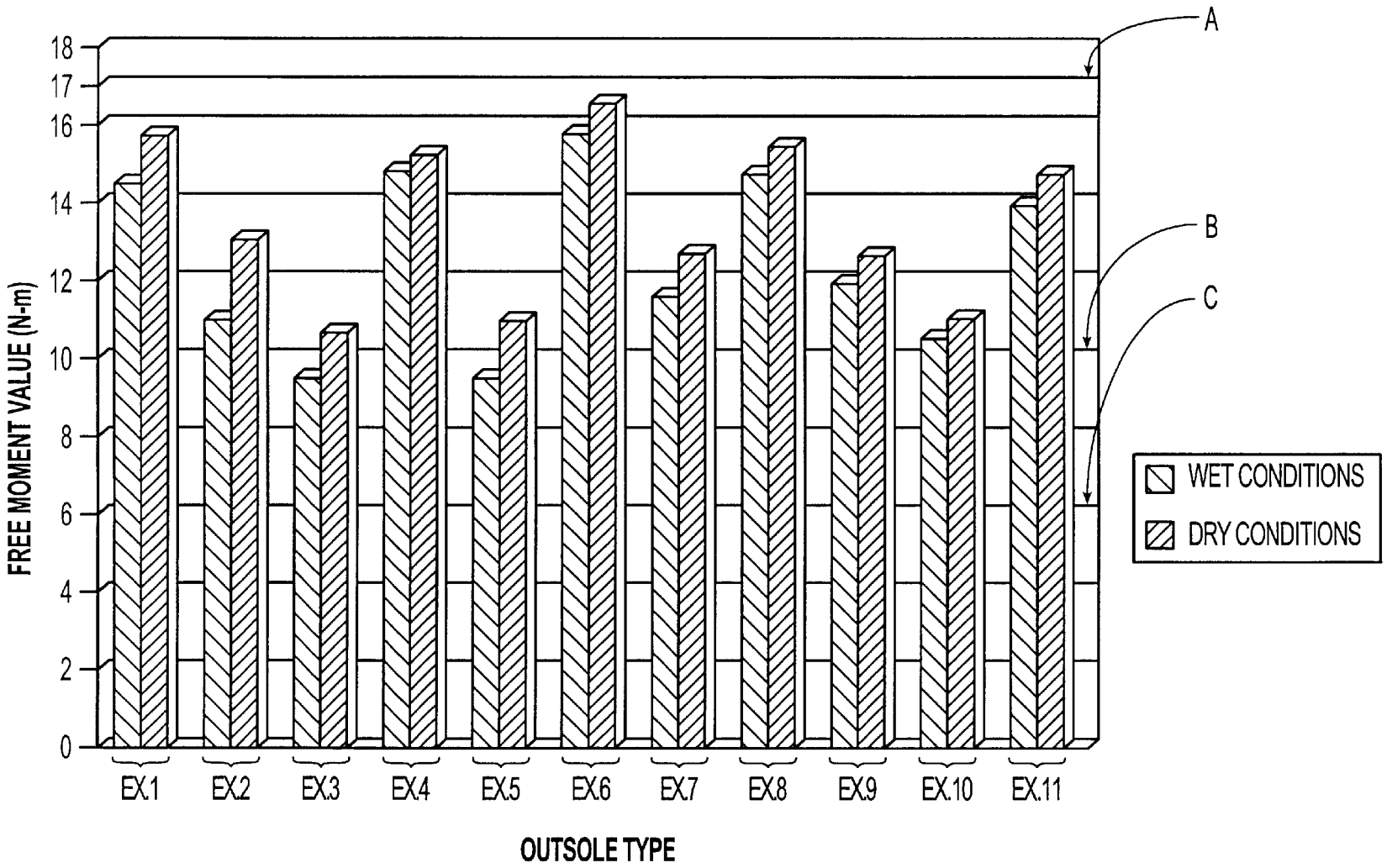
FIG. 13 in graph comparing the traction torsion of various conventional outsoles with the outsole of the present invention.

Referring to FIG. 13 and Table III, test data obtained from shoes having various outsole and traction system configurations is provided. In particular, the traction torsion was measured for shoes including those according to the present invention. Example 1 has the outsole formed according to the present invention. Examples 2–11 have conventional outsoles (DryJoys® with 8 mm Metal Spike, DryJoys®, DryJoys®GX, Classics®, TurfMasters™, Sierra®, Terrains™, Sports, Sports Athletic, and Green-Joys®, respectively) for comparison. Examples 3–11 have outsoles with SOFTSPIKES® XP™ cleats therein.

Each outsole was tested on a testing device, which included a force platform with artificial turf. Once a shoe was placed on the platform with the traction configuration (i.e., spikes, cleats, etc.) in contact with the turf, a known load is applied to the shoe. The load causes the shoe to rotated through a predetermined angle. The force platform records the moment of force or free moment applied to the shoe by the traction configuration during rotation. The greater the free moment, the greater the resistance to rotation, and thus the greater the stability of the golfer's foot during the swing. Measurements were taken in both wet and dry conditions, and average free moment values of numerous trials appear in Table III. with units of N-m.

Referring to FIG. 13, a threshold labeled with the letter A, represents a free moment value of 17 N-m. Free moment values above the threshold A are considered to have more traction than is necessary for a golfer to swing effectively. A threshold labeled with the letter B, represents a free moment value of 10 N-m. Free moment values between thresholds A and B are considered to have "excellent" traction. A threshold value labeled with the letter C, represents a free moment value of 6 N-m. Free moment values between thresholds B and C are considered to have "good" traction. Free moment values less than the threshold C are considered to have "poor" traction, and may allow the golfer to slip during the swing.

TABLE III

Traction Torsion Test Results

| Sample | Free Moment in Wet Conditions (N-m) | Free Moment in Dry Conditions (N-m) |
|---|---|---|
| Example 1 | 14.5 | 15.7 |
| Example 2 | 10.96 | 12.99 |
| Example 3 | 9.5 | 10.6 |
| Example 4 | 14.8 | 15.2 |
| Example 5 | 9.5 | 10.9 |
| Example 6 | 15.7 | 16.5 |
| Example 7 | 11.6 | 12.6 |
| Example 8 | 14.7 | 15.4 |
| Example 9 | 11.9 | 12.6 |
| Example 10 | 10.5 | 11 |
| Example 11 | 13.9 | 14.7 |

Referring to FIG. 13 and Table III, the outsoles according to the present invention (Example 1) have greater free moment values than the outsoles with metal spikes (Example 2) in both wet and dry conditions. Thus, traction provided by a metal spike is exceeded with the inventive outsole. Compared to all the conventional outsoles, the inventive outsoles (Example 1) have the fourth highest free moment value in wet conditions, and the second highest free moment values in dry conditions. In both conditions, the free moment values for the inventive outsole are in the excellent traction range. Thus, the inventive outsoles are flexible enough to provide good comfort, and have better traction than conventional metal spike outsoles. Thus, these outsoles provide the advantages of non-metal spikes (i.e., decreased turf compaction and smaller holes, and high traction and flexibility.

While it is apparent that the illustrative embodiments of the invention disclosed herein fulfill the objectives stated above, it will be appreciated that modifications and other embodiments may be devised by those skilled in the art. Therefore, it will be understood that the appended claims are intended to cover all such modifications and embodiments which would come within the spirit and scope of the present invention.

What is claimed is:

1. An outsole including a first end, a longitudinally spaced second end, and a longitudinial axis extending between the first end and the second end, wherein the outsole comprises:

a) a first layer formed from a first material, the first layer includes a first surface, and an opposed second surface and defining a plurality of first holes at spaced locations that extend from the first surface to the second surface; and b) a second layer formed from a second material, the second layer including a base adjacent to the first surface of the first layer and the second layer further including a plurality of projections extending from the base through the associated first holes and extending outwardly from the second surface of the first layer, each projection including i. a pointed free end; and ii. a ridge extending from the second surface to the free end, wherein the ridge is substantially parallel to the longitudinal axis, wherein the second material is continuous and uninterrupted from the base to the pointed free end.

2. The outsole of claim 1, wherein each projection further include a conical portion that includes the pointed free end.

3. The outsole of claim 2, wherein each projection has an outline that engages the second surface of the first layer, and the outline has tear-drop shape so that the tear-drop shape is formed by a rounded end and an opposed tapered end, and the rounded end of each projection is closer to the first end of the outsole and the tapered end of each projection is closer to the second end of the outsole.

4. The outsole of claim 3, wherein the outline defining an area larger than the diameter of the first holes and covering each entire first hole.

5. The outsole of claim 4, wherein the projections cover less than 50% of the surface area of the outsole.

6. The outsole of claim 4, wherein the first material and the second material are thermoplastic polyurethanes.

7. The outsole of claim 4, wherein the outsole from the first end to the second end is defined by a toe section, a forefoot section, a shank section, and a heel section, and the first material has a first Shore A durometer and the second material has a second Shore A durometer, and the first Shore A durometer is greater than the second Shore A durometer for the outsole from the toe section to the shank section.

8. The outsole of claim 7, wherein the first Shore A durometer is between about 80 to about 90 points, and the second Shore A durometer is between about 70 to about 80 points for the outsole from the toe section to the shank section.

9. The outsole of claim 8, wherein the first Shore A durometer is about 85 points, and the second Shore A durometer is about 75 points for the outsole from the toe section to the shank section.

10. The outsole of claim 9, wherein the second Shore A durometer for the heel section is greater than the first Shore A durometer.

11. The outsole of claim 1, wherein the first layer further includes at least two longitudinally spaced pieces, and the base extends therebetween to form at least one hinge.

12. The outsole of claim 11, wherein each piece includes transversely spaced sides, a front end, and a longitudinally spaced back end, and the projections are at spaced locations across each piece from one side to the other side and along each piece from the front end to the back end.

13. The outsole of claim 12, wherein the first layer includes at least three longitudinally spaced pieces, and the base extends between the pieces to form two hinges.

14. The outsole of claim 13, wherein the outsole further includes a length from the first end to the second end and the hinges are located between about 30% to about 35% of the length of the outsole from the first end so that the hinges under lie a wearer's metatarsals.

15. The outsole of claim 12, wherein the first layer further includes:

a) a plurality of spaced second holes extending through said first layer between the first surface and the second surface; and b) a plurality of receptacles each having an internally threaded bore, and the receptacles being disposed in the second holes so that each threaded bore is adapted to threadably receive a cleat.

16. The outsole of claim 1, wherein the base and the projections are integrally formed from the base to the pointed free end.

17. The outsole of claim 1, wherein the second layer is a single piece.

18. The outsole of claim 1, wherein the second layer covers a substantial portion of the first surface.

19. The outsole of claim 1, wherein the base and the projections are formed by molding the second material through the first holes of the first layer.

20. An outsole including a first end, a longitudinally spaced second end, and a longitudinal axis extending between the first end and the second end, wherein the outsole comprises:

a) a first layer formed from a first material, the first layer includes a first surface, and an opposed second surface and defining a plurality of first holes at spaced locations that extend from the first surface to the second surface, the first holes each having a diameter, the first layer further including at least two longitudinally spaced pieces; and b) a second layer formed from a second material, the second layer includes a base adjacent the first surface of the first layer and, the second layer further including and a plurality of projections extending from the base through the associated first holes and extending outwardly from the second surface of the first layer, said base having a portion extending longitudinally between the pieces of the first layer, each projection having an outline engaged with the second surface, and the outline defining an area larger than the diameter of the first holes and each outline covering the each entire first hole, wherein the second material is continuous and uninterrupted from the base to a free end of each projection.

21. The outsole of claim 20, wherein the portion of the base extending between the pieces of the first layer forms at least one hinge.

22. The outsole of claim 20, wherein the first layer includes at least three longitudinally spaced pieces, and the base extending longitudinally between the pieces to form two hinges.

23. The outsole of claim 22, wherein each outline has tear-drop shape so that the tear-drop shape is formed by a rounded end and an opposed tapered end, and the rounded end of each projection is closer to the first end of the outsole and the tapered end of each projection is closer to the second end of the outsole.

24. The outsole of claim 22, wherein each piece includes transversely spaced sides, a front end, and a longitudinally spaced back end, and the projections are at spaced locations across each piece from one side to the other side and along each piece from the front end to the back end.

25. The outsole of claim 24, wherein the first material and the second material are thermoplastic polyurethanes.

26. The outsole of claim 25, wherein the outsole from the first end to the second end is defined by a toe section, a forefoot section, a shank section, and a heel section, and the first material has a first Shore A durometer and the second material has a second Shore A durometer, and the first Shore A durometer is greater than the second Shore A durometer of the outsole from the toe section to the shank section.

27. The outsole of claim 26, wherein the first Shore A durometer is between about 80 to about 90 points, and the second Shore A durometer is between about 70 to about 80 points for the outsole from the toe section to the shank section.

28. The outsole of claim 27, wherein the first Shore A durometer is about 85 points, and the second Shore A durometer is about 75 points for the outsole from the toe section to the shank section for the outsole from the toe section to the shank section.

29. The outsole of claim 28, wherein the second Shore A durometer for the heel section is greater than the first Shore A durometer.

30. The outsole of claim 20, wherein the first holes each have a diameter, and each projection has an outline engaged with the second surface, and a minimum width of the outline is greater than a diameter of the first holes.

31. The outsole of claim 20, wherein the base and the projections are integrally formed from the base to the free end of each projection.

32. The outsole of claim 20, wherein the second layer is a single piece.

33. The outsole of claim 20, wherein the second layer covers a substantial portion of the first surface.

34. The outsole of claim 20, wherein the base and the projections are formed by molding the second material through the first holes of the first layer.

* * * * *